US011621120B2

(12) United States Patent
Ishimori et al.

(10) Patent No.: US 11,621,120 B2
(45) Date of Patent: Apr. 4, 2023

(54) AIR-CORE REACTOR FOR VEHICLE

(71) Applicant: Mitsubishi Electric Corporation, Tokyo (JP)

(72) Inventors: Yuki Ishimori, Tokyo (JP); Tetsuya Sakurada, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 418 days.

(21) Appl. No.: 16/625,965

(22) PCT Filed: Jul. 3, 2017

(86) PCT No.: PCT/JP2017/024320

§ 371 (c)(1),
(2) Date: Dec. 23, 2019

(87) PCT Pub. No.: WO2019/008621

PCT Pub. Date: Jan. 10, 2019

(65) Prior Publication Data

US 2020/0176177 A1 Jun. 4, 2020

(51) Int. Cl.
*H01F 27/30* (2006.01)
*H01F 37/00* (2006.01)

(52) U.S. Cl.
CPC ..... *H01F 27/306* (2013.01); *H01F 37/005* (2013.01)

(58) Field of Classification Search
CPC ..... H01F 27/306; H01F 37/005
USPC ..... 336/180, 185
See application file for complete search history.

(56) References Cited

U.S. PATENT DOCUMENTS 1,396,563 A * 11/1921 Faccioli ..... H01F 27/2871 336/185
1,580,811 A * 4/1926 Burnham ..... H01F 27/085 336/98
2,370,045 A * 2/1945 Keto ..... H01F 27/36 336/84 R
2,632,041 A * 3/1953 Bilodeau ..... H01F 27/306 336/185

(Continued)

FOREIGN PATENT DOCUMENTS

AU 2012211161 A1 * 7/2013 ..... B01J 19/249
CN 201820576 U * 5/2011

(Continued)

OTHER PUBLICATIONS

International Search Report (PCT/ISA/210) dated Sep. 12, 2017, by the Japan Patent Office as the International Searching Authority for International Application No. PCT/JP2017/024320.

(Continued)

*Primary Examiner* — Elvin G Enad
*Assistant Examiner* — Joselito S. Baisa
(74) *Attorney, Agent, or Firm* — Buchanan Ingersoll & Rooney PC

(57) ABSTRACT

A reactor includes a coil that has unit coils. Spacers are disposed in (i) at least one of spaces between the unit coils adjacent to each other in the central axis direction and (ii) a space between each of the support frames and the unit coil. Bolts penetrate the support frame and the spacers, and the spacers are fixed to the bolts The bolts include fitting portions to be fitted to one of the spacers on a notch or a through hole formed in a projection part of the spacer.

19 Claims, 18 Drawing Sheets

(56) References Cited

U.S. PATENT DOCUMENTS

| | | | | | |
|---|---|---|---|---|---|
| 2,756,397 | A * | 7/1956 | Cederstrom | ..... | H01F 27/306<br>336/185 |
| 2,901,717 | A * | 8/1959 | Storsand | ..... | H01F 37/005<br>336/174 |
| 11,328,856 | B2 * | 5/2022 | Ishimori | ..... | H01F 27/306 |

FOREIGN PATENT DOCUMENTS

| | | | | |
|---|---|---|---|---|
| CN | 203706778 | U | * | 7/2014 |
| JP | S6113914 | U | | 1/1986 |
| JP | H04317308 | A | | 11/1992 |
| JP | 2000164433 | A | | 6/2000 |
| JP | 2016225482 | A | * | 12/2016 |

OTHER PUBLICATIONS

Written Opinion (PCT/ISA/237) dated Sep. 12, 2017, by the Japan Patent Office as the International Searching Authority for International Application No. PCT/JP2017/024320.

* cited by examiner

AIR-CORE REACTOR FOR VEHICLE

TECHNICAL FIELD

The present disclosure relates to an air-core reactor for vehicle installed in a railroad vehicle.

BACKGROUND ART

A reactor is installed in a railroad vehicle for the purpose of inhibiting an abrupt change in an electric current flowing in a main circuit. As a reactor placed beneath a floor of the railroad vehicle, a horizontal reactor with a coil whose central axis is horizontal is used for preventing a magnetic flux from leaking into the railroad vehicle. The horizontal reactor installed in the railroad vehicle is an air-core reactor with a coil that is sufficiently cooled down during natural cooling. The air-core reactor includes a coil wound around a horizontal central axis and a support frame attached to the coil. The support frame is attached to a vehicle body, whereby the air-core reactor is fixed to the vehicle body.

To reduce loss in the coil during energization, materials such as aluminum or copper are used for the coil. For the support frame and for a bolt securing the coil to the support frame, ferrous materials such as carbon steel are used. The coil is different from the support frame and bolt in material, and thus the coil is different from the support frame and bolt in linear expansion coefficient.

In an air-core self-cooling reactor disclosed in Patent Literature 1, disc-shaped coils are each fastened and supported by fastening studs to a coil support frame via spacers, each of which is inserted between coils and abuts against the coils.

CITATION LIST

Patent Literature

Patent Literature 1: Unexamined Japanese Patent Application Kokai Publication No. H04-317308

SUMMARY OF INVENTION

Technical Problem

For example, when the coil is energized and the temperature of the coil rises, a thermal stress is caused depending on a difference in expansion between the coil and the support frame, the difference in expansion arising from a difference in heat expansion coefficient between the coil and the support frame. In cases where the coil is fixed to the support frame as in the air-core self-cooling reactor disclosed in Patent Literature 1, a compression force caused by a thermal stress is applied to the coil.

The present disclosure is made in view of the foregoing circumstances, and an objective of the disclosure is to reduce a load on the coil, the load being based on a thermal stress.

Solution to Problem

To achieve the aforementioned objective, an air-core reactor for a vehicle of the present disclosure includes a coil, a pair of support frames, spacers, bolts, fastening members, and an insulating support member. The coil has unit coils wound around a central axis that is horizontal, the unit coils being adjacent to each other with a space therebetween in a central axis direction that is a direction of the central axis.

The pair of support frames face each other in the central axis direction with the coil sandwiched between the pair of support frames. The spacers are disposed in (i) at least one of spaces between the unit coils adjacent to each other in the central axis direction and (ii) a space between each of the support frames and the coil, and the spacers include projection parts that project outwardly from an outer peripheral face of the coil around the central axis. Each of the projection parts has a notch or a through hole that penetrates the corresponding projection part in the central axis direction. The bolts pass through the notches or the through holes in the projection parts of the spacers and penetrate the pair of support frames. The fastening members are fastened to the bolts to sandwich the pair of support frames so that the pair of support frames and the spacers are fixed to the bolts. The support member vertically supports the coil by abutting on the outer peripheral face of the coil or on an inner peripheral face of the coil around the central axis. Each of the bolts includes fitting portions fitted to the spacers on the notches or the through holes in the projection parts of the spacers.

Advantageous Effects of Invention

According to the present disclosure, each of the bolts is provided with the fitting portions fitted to the spacers, with the result that a load on the coil based on a thermal stress can be reduced.

DESCRIPTION OF EMBODIMENTS

Figure 1:
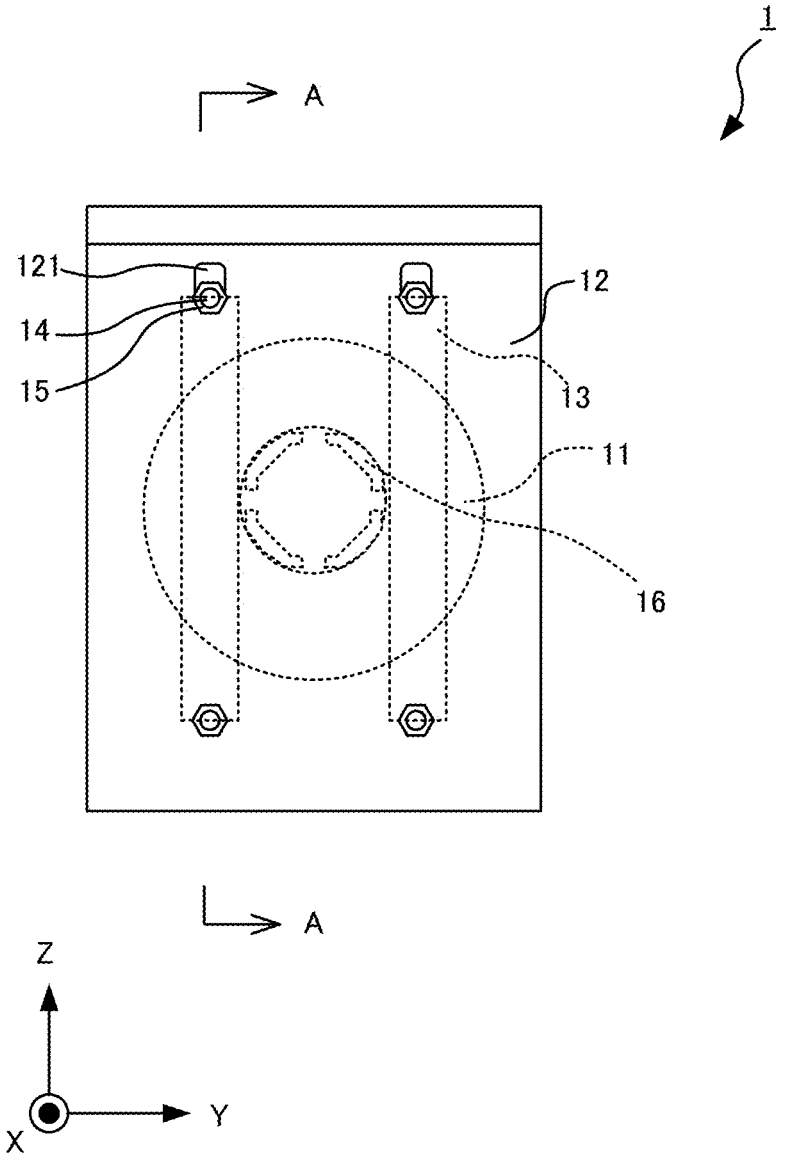
FIG. 1 is a side view of a reactor according to an embodiment of the present disclosure.

Embodiments of the present disclosure are described below in detail with reference to the drawings. In the drawings, components that are the same or equivalent are assigned the same reference signs.

Figure 2:
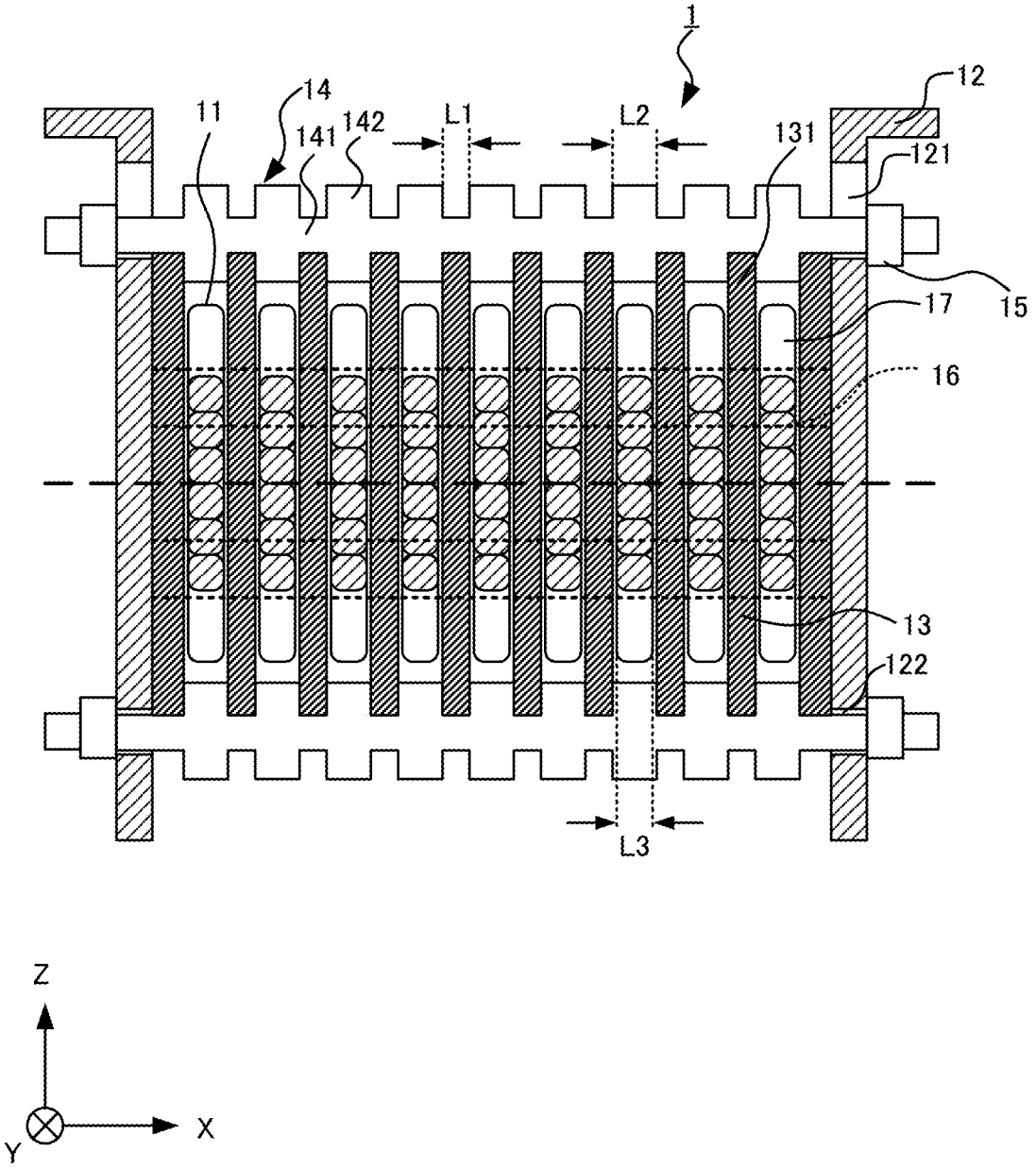
FIG. 2 is a cross-sectional view of the reactor according to the embodiment.

FIG. 1 is a side view of a reactor according to an embodiment of the present disclosure. FIG. 2 is a cross-sectional view of the reactor according to the embodiment. FIG. 2 is a cross-sectional view taken along line A-A in FIG. 1. FIG. 2 is a cross-sectional view of a reactor 1 when the temperature of a coil 11 is an ordinary temperature, for example, when the coil 11 is not energized. The ordinary temperature refers to a temperature in a predetermined range of temperatures including 20 degrees centigrade, for example. The reactor 1 is an air-core type reactor installed in a railroad vehicle. For example, the reactor 1 is installed beneath a floor of the railroad vehicle. When the railroad vehicle is located on a horizontal plane, a central axis of the coil 11 included in the reactor 1 is horizontal. In FIG. 2, the central axis of the coil 11 is indicated by a broken line. In FIGS. 1 and 2, the Z-axis corresponds to a vertical direction, the X-axis corresponds to a horizontal direction, and the Y-axis corresponds to a direction perpendicular to the X-axis and to the Z-axis.

The coil 11 includes a plurality of unit coils 17 that is wound around the central axis and are arranged along the X-axis direction at intervals. The reactor 1 includes a pair of support frames 12 and a plurality of spacers 13. The support frames 12 face each other with the coil 11 sandwiched between the support frames 12 in a central axis direction that is a direction of the central axis of the coil 11. The spacers 13 are disposed (i) at least one of spaces between the unit coils 17 and (ii) a space between each of the support frames 12 and the coil 11. Each spacer 13 may be made of, for example, fiber-reinforced plastics (FRP), a resin or the like to have insulating properties. In cases where the spacer 13 does not have insulating properties, an insulating material has only to be disposed between the spacer 13 and the unit coil 17 or between the spacer 13 and the support frame 12. The spacer 13 has a projection part 131 that projects outwardly from the outer peripheral face of the coil 11 around the central axis. Disposing the spacer 13 between the unit coils 17 ensures that an air passage is created between the unit coils 17, and thus the cooling performance of the reactor 1 can be improved. The reactor 1 may further include a cover covering the coil 11 around the central axis.

The projection part 131 of the spacer 13 has a notch or a through hole that penetrates the projection part 131 in the central axis direction. In the examples of FIGS. 1 and 2, a notch is formed in the projection part 131 as described later. A plurality of bolts 14 penetrates the pair of support frames 12 and the spacers 13. The bolts 14 pass through insertion holes 121 and 122 in each support frame 12. The bolts 14 also pass through the notches or the through holes in the projection parts 131. A plurality of fastening members 15 is fastened to both ends of each of the bolts 14 with the pair of support frames 12 sandwiched between the fastening members 15, whereby the pair of support frames 12 and the spacers 13 are fixed to the bolts 14. The plurality of bolts 14 and the plurality of fastening members 15 each are made of a metal having stiffness of at least a predetermined value, such as steel or stainless steel. The predetermined value is determined in accordance with the design of the reactor 1. Each of the bolts 14 is placed at a position that ensures an insulation distance to the coil 11. The reactor 1 further includes an insulating support member 16 that abuts on an inner peripheral face or the outer peripheral face of the coil 11 around the central axis to inhibit the coil 11 from moving along the X-axis direction and to support the coil 11 in the Z-axis direction.

Each bolt 14 includes a plurality of fitting portions 141 to be fitted to the spacers 13 in the notches or the through holes in the projection parts 131 of the spacers 13. The bolt 14 may further include a fixing portion 142. The fixing portion 142 is adjacent to at least one of the fitting portions 141 among the plurality of fitting portions 141. The fixing portion 142 inhibits a spacer 13 among the spacers 13 that is fitted to the fitting portion 141 adjacent to the fixing portion 142 from deviating in the central axis direction with respect to the bolt 14. In the present embodiment, the fitting portions 141 and the fixing portions 142 are alternately disposed on the bolt 14. For example, the fixing portion 142 abuts, in the central axis direction, against the spacer 13 fitted to the fitting portion 141, thereby separating the spacer 13 from the unit coil 17 and inhibiting the spacer 13 from deviating in the central axis direction with respect to the bolt 14. In the example of FIG. 2, the spacer 13 is disposed in every space between the adjacent unit coils 17. The length L1 along the X-axis direction of the fitting portion 141 is equal to the length along the X-axis direction of the spacer 13 to which the fitting portion 141 is fitted. The length L2 along the X-axis direction of the fixing portion 142 is greater than the length L3 along the X-axis direction of the unit coil 17 placed between the spacers 13 fitted to the fitting portions 141 adjacent to the fixing portion 142, when the temperature of the unit coil 17 is an ordinary temperature. The foregoing configuration ensures that a gap is present between the unit coil 17 and the spacer 13 when the temperature of the coil 11 is an ordinary temperature, for example, when the coil 11 is not energized. Therefore, the configuration can reduce a load on the coil 11 based on a thermal stress that is caused when the temperature of the coil 11 is risen due to energization of the coil 11.

Even in a case in which the temperature of the coil 11 rises, the fixing portion 142 may abut, in the central axis direction, against the spacer 13 fitted to the fitting portion 141, thereby separating the spacer 13 from the unit coil 17 and inhibiting the spacer 13 from deviating in the central axis direction with respect to the bolt 14. The length L2 along the X-axis direction of the fixing portion 142 may be greater than the length along the X-axis direction of the unit coil 17 placed between the spacers 13 fitted to the fitting portions 141 adjacent to the fixing portion 142 in a case in which a rise in the temperature of the unit coil 17 included in the coil 11 is caused by, for example, the application of electric current to the coil 11. Hence, a gap is present between the unit coil 17 and the spacer 13 not only when the unit coil 17 has an ordinary temperature but also when the unit coil 17 expands in the X-axis direction due to a temperature rise in the unit coil 17, thereby enabling a reduction in a load on the coil 11 based on a thermal stress that is caused when the temperature of the coil 11 rises.

The spacers 13 may have the same or different lengths along the X-axis direction. For example, the length along the X-axis direction of the spacer 13 adjacent to the support frame 12 is determined in accordance with an insulation distance between the support frame 12 and the coil 11. When the length of the spacer 13 along the X-axis direction is determined in accordance with an insulation distance between the support frame 12 and the coil 11, the length of the fitting portion 141 along the X-axis direction is also determined in accordance with the insulation distance between the support frame 12 and the coil 11.

In the examples of FIGS. 1 and 2, the unit coil 17 is a disc-type coil wound around the central axis, and the reactor 1 includes a plurality of the unit coils 17 arranged along the X-axis direction. The coil 11 is made of aluminum or copper. The coil 11 may be a coil conductor wound around the central axis in a helical manner. In this case, a portion per turn of the coil conductor wound around the central axis in a helical manner corresponds to the unit coil 17.

In the examples of FIGS. 1 and 2, the reactor 1 includes a plurality of pairs of spacers 13, each pair of spacers 13 being opposed to each other in the horizontal direction with the central axis between the spacers 13 and extending in the vertical direction. Each of both ends of the spacer 13 in the Z-axis direction forms the projection part 131. Each spacer 13 is a rectangular solid in the examples of FIGS. 1 and 2, but the spacer 13 may be in any shape. The reactor 1 may include any number of spacers 13. The spacer 13 may be oriented in any way as long as the projection parts 131 included in the spacer 13 is outside the outer peripheral face of the coil 11. The spacer 13 is disposed in every space between adjacent unit coils 17 in the example of FIG. 2, but the spacers 13 may be disposed at any intervals. For example, the spacer 13 may be disposed in every other space between adjacent unit coils 17.

Figure 3:
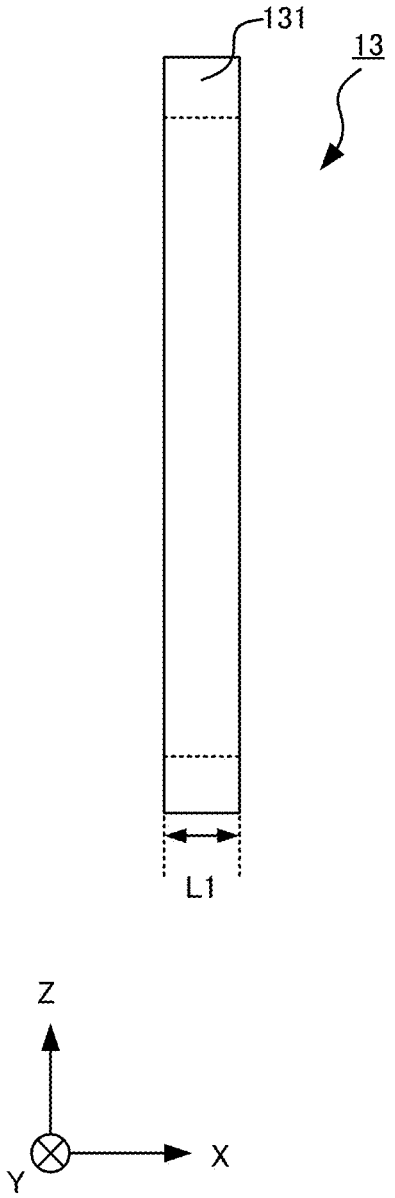
FIG. 3 is a front view of a spacer according to the embodiment.
Figure 4:
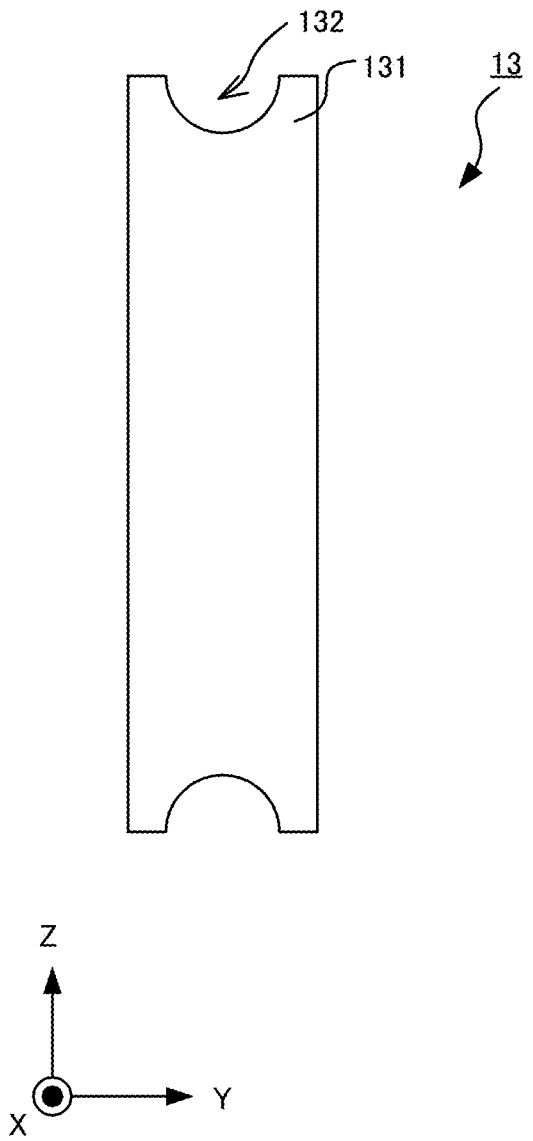
FIG. 4 is a side view of the spacer according to the embodiment.

FIG. 3 is a front view of the spacer according to the embodiment. FIG. 4 is a side view of the spacer according to the embodiment. Each of both ends of the spacer 13 in the Z-axis direction forms the projection part 131. In the examples of FIGS. 3 and 4, a notch 132 extending in the Z-axis direction is formed in the projection part 131. In the embodiment, the bolt 14 is cylindrical, and the fitting portion 141 and the fixing portion 142 are also cylindrical. The outer peripheral face of the fitting portion 141 is fitted to the notch 132.

Figure 5:
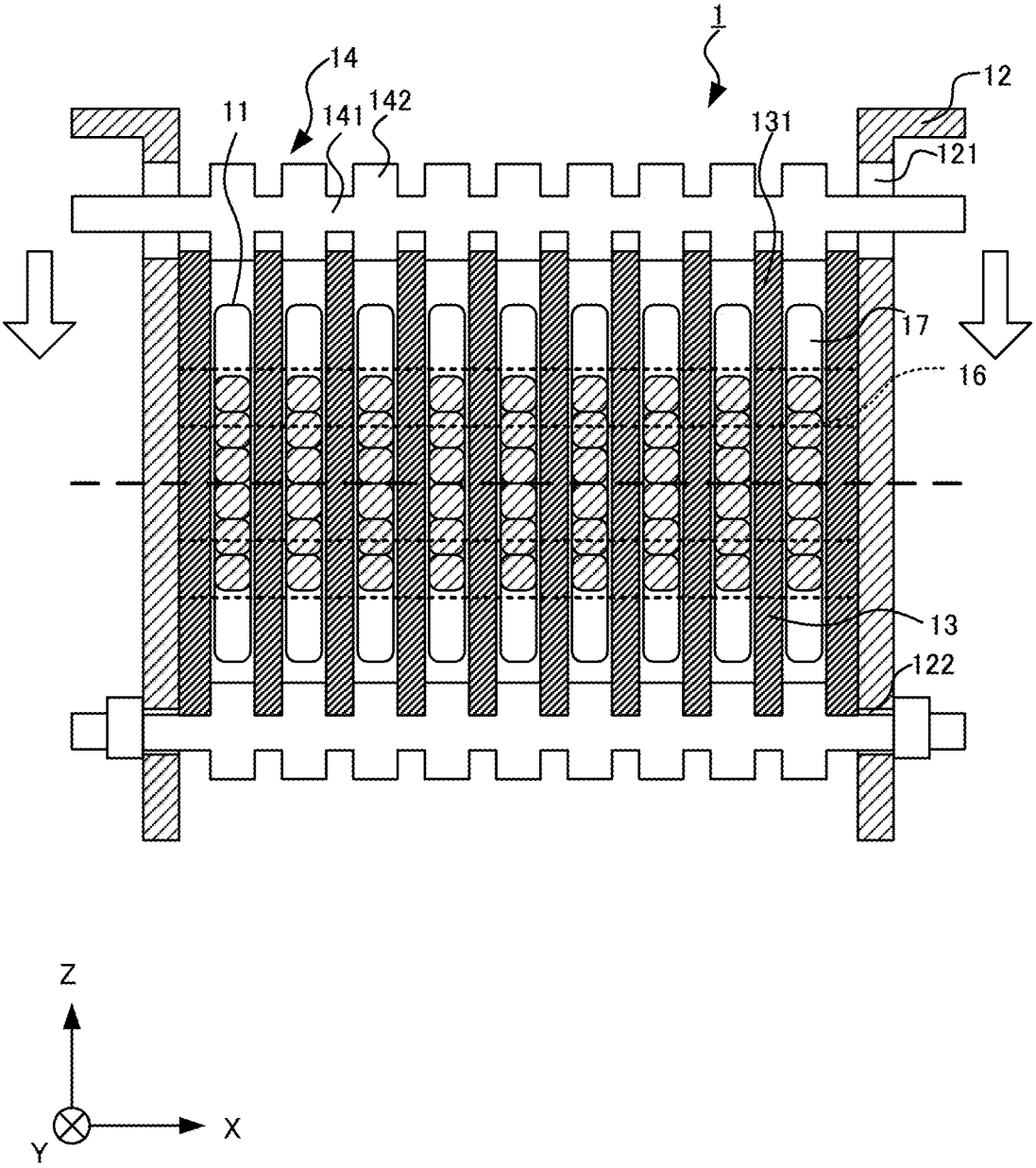
FIG. 5 is a drawing illustrating an example of a method of assembling the reactor according to the embodiment.

FIG. 5 illustrates an example of a method of assembling the reactor according to the embodiment. The reactor 1 is assembled as described below. One end of the support member 16 is fixed to one support frame 12 of the support frames 12. The bolt 14 passes through the insertion hole 122 located at a lower position of the one support frame 12 in the Z-axis direction. The notch 132 in the projection part 131 is fitted to the fitting portion 141 of the bolt 14 so that the spacer 13 is placed next to the one support frame 12. The unit coil 17 is placed at a position separate from the spacer 13. Then, the process of placing another spacer 13 and another unit coil 17 is repeated. After the last unit coil 17 is placed, the spacer 13 is placed. The other support frame 12 is placed next to this spacer 13, and the support member 16 is fixed to the other support frame 12. The bolt 14 passes through the insertion holes 121 located at an upper position of the pair of support frames 12 in the Z-axis direction and, as indicated by arrows in FIG. 5, the bolt 14 is moved in the Z-axis direction to fit the fitting portions 141 into the notches 132 in the projection parts 131 of the spacers 13. Afterward, the fastening members 15 are fastened to the bolts 14 as illustrated in FIG. 2, whereby the reactor 1 is completely assembled.

Figure 6:
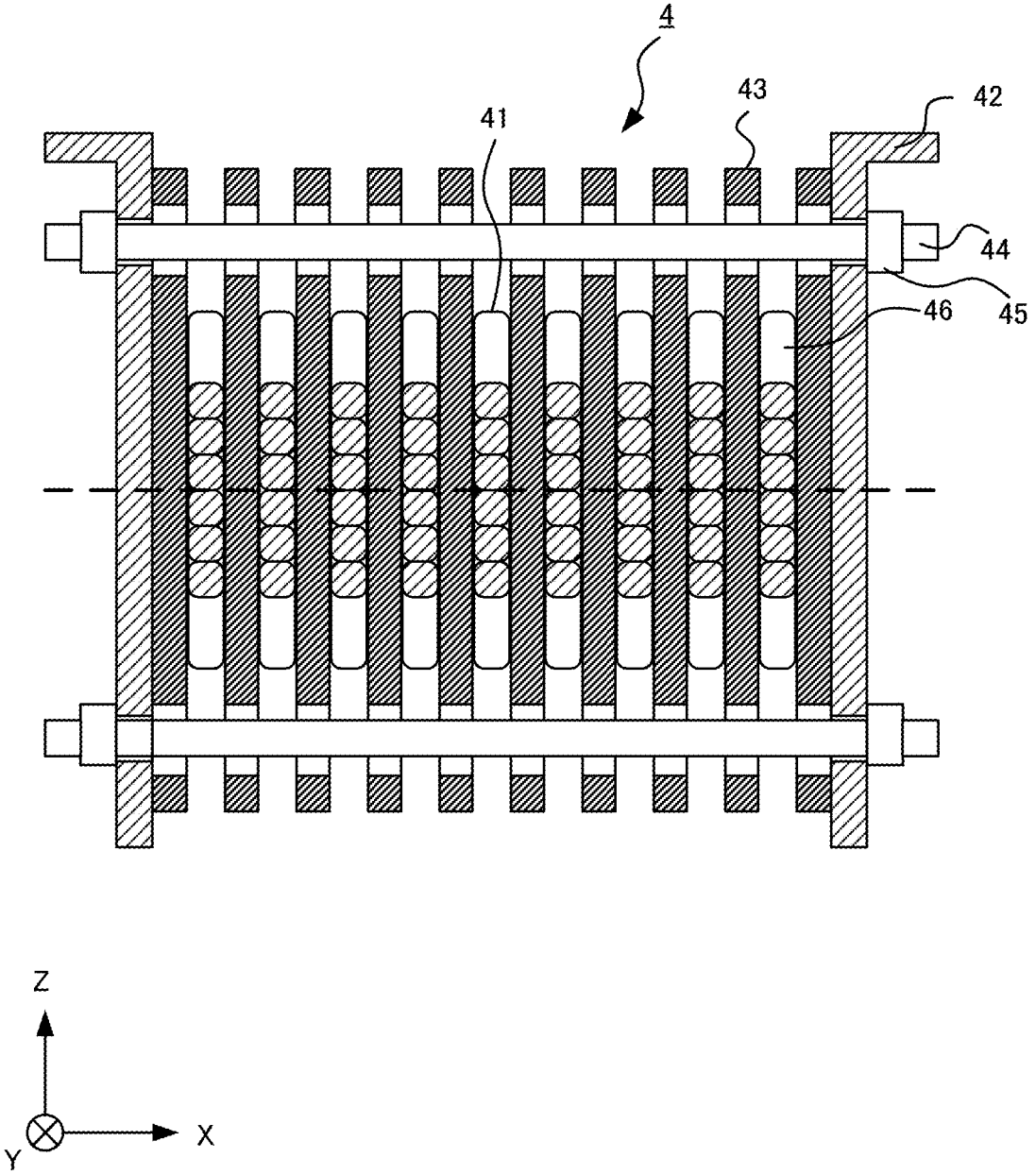
FIG. 6 is a cross-sectional view of a reactor in which a coil is pressed.

FIG. 6 is a cross-sectional view of a reactor in which a coil is pressed. A reactor 4 in FIG. 6 includes a coil 41, a pair of support frames 42, and a plurality of spacers 43. The coil 41 including a plurality of unit coils 46 that are wound around the central axis and are adjacent to each other with a space therebetween in the X-axis direction, the pair of support frames 42 facing each other with the coil 41 sandwiched between the support frames 42 in the X-axis direction, and the spacers 43 having insulating properties and being disposed in (i) at least one of spaces between the unit coils 46 and (ii) a space between each of the support frames 42 and the coil 41. The spacer 43 abuts on each of adjacent unit coils 46 between which the spacer 43 is sandwiched. A plurality of bolts 44 penetrates the pair of support frames 42 and the spacers 43. Fastening members 45 are fastened to both ends of each of the bolts 44, whereby the pair of support frames 42 and the spacers 43 are fixed to the bolts 44. A compression force caused by the fastening of the bolts 44 is applied to the coil 41, the support frames 42, and the spacers 43.

Figure 7:
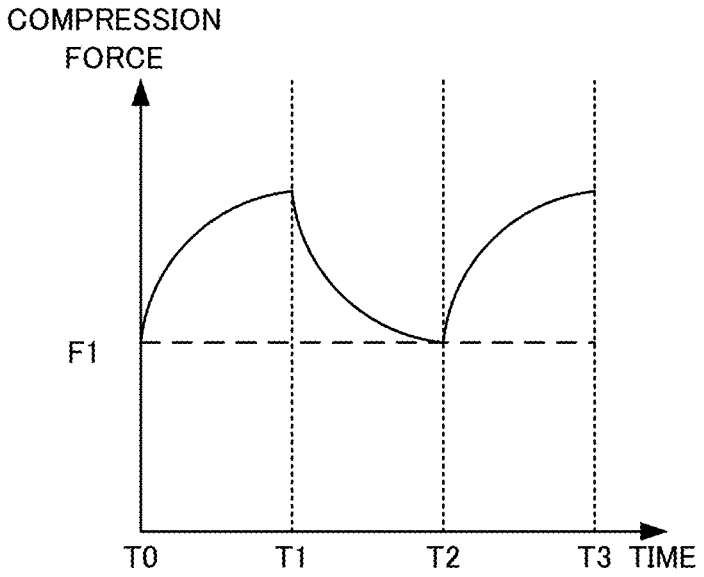
FIG. 7 is a drawing illustrating an example of a compression force applied to the coil.

FIG. 7 is a drawing illustrating an example of a compression force applied to the coil. In FIG. 7, the horizontal axis represents time and the vertical axis represents the compression force. FIG. 7 illustrates compression force applied to the coil 41 illustrated in FIG. 6. From time T0 to time T1 and from time T2 to time T3, the coil 41 carries an electric current. From time T1 to time T2, the coil 41 carries no electric current. Although the coil 41 carries no electric current at time T0 or time T2, a compression force F1 caused by the fastening of the bolt 44 is applied to the coil 41, as described above. From time T0 to time T1 and from time T2 to time T3, the coil 41 carries an electric current, which causes the coil 41 to expand and therefore a thermal stress is created on the coil 41. In other words, when the coil 41 is carrying an electric current, an excessive stress may be created on the coil 41.

Figure 8:
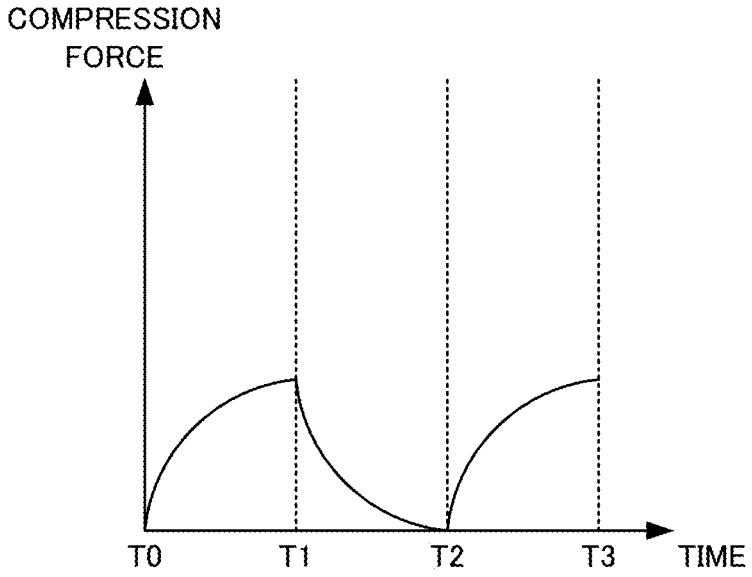
FIG. 8 is a drawing illustrating an example of a compression force applied to the coil in the reactor according to the embodiment.

FIG. 8 is a drawing illustrating an example of a compression force applied to the coil in the reactor according to the embodiment. This drawing is viewed in a manner similar to that of FIG. 7. Unlike the reactor 4, at time T0 and time T2, no compression force is applied to the coil 11 in the reactor 1 according to the embodiment. Therefore, the coil 11 does not suffer an excessive stress even when the coil 11 is carrying an electric current.

In the examples of FIGS. 1 and 2, both ends of the support member 16 are fixed to the pair of support frames 12. The support member 16 abuts on the inner peripheral face of the coil 11 to be fixed to the coil 11. Thus, the support member 16 inhibits the coil 11 from moving in the X-axis direction and supports the coil 11 in the Z-axis direction. The reactor 1 includes four support members 16 in the examples of FIGS. 1 and 2, but the shape of the support member 16 is not limited to those illustrated in the examples of FIGS. 1 and 2. For example, the reactor 1 may include a cylindrical support member 16 whose outer peripheral face abuts on the inner peripheral face of the coil 11. Providing a vent hole in the support member 16 can improve cooling performance of the reactor 1. Any method may be used to fix the support member 16 to the coil 11; for example, a groove disposed on the outer peripheral face of the support member 16 may be fitted to the inner peripheral face of the coil 11.

The spacers 13 each disposed between the unit coils 17 may have the same length along the X-axis direction as illustrated in FIG. 2 or may have a varying length determined on the basis of distances from each of the pair of support frames 12. For example, the spacer 13 may have a greater length as the difference between distances from the pair of support frames 12 to the spacer 13 becomes smaller, that is, as the spacer 13 comes closer to the center from both ends of the coil 11 in the X-axis direction. As a result, the coil 11 can achieve higher cooling efficiency in the middle region of the coil 11 in the X-axis direction, the temperature of the middle region rising more greatly than the temperature of the ends of the coil 11 in the X-axis direction when the coil 11 is energized.

Figure 9:
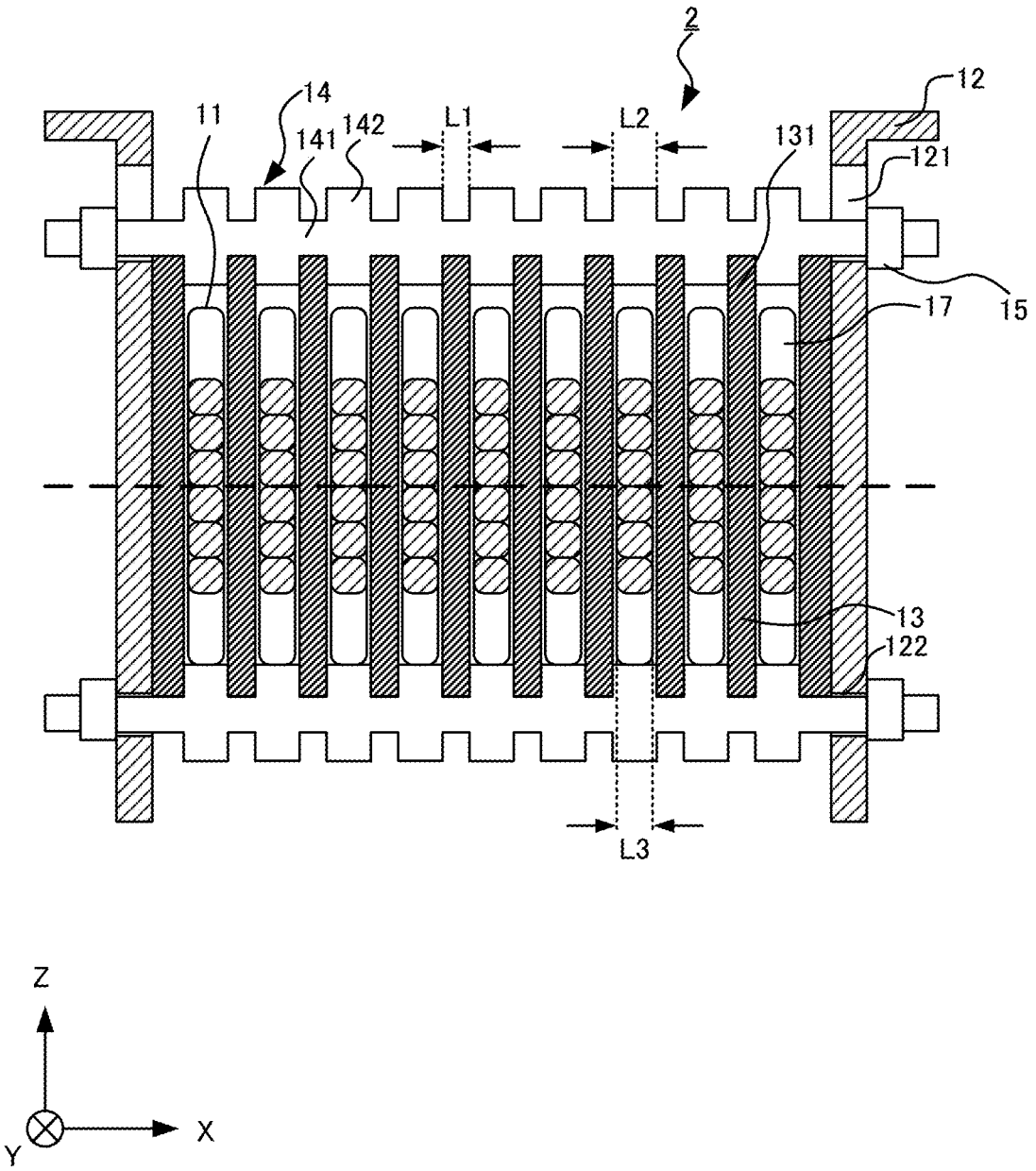
FIG. 9 is a cross-sectional view of a first variation of the reactor according to the embodiment.

FIG. 9 is a cross-sectional view of a first variation of the reactor according to the embodiment. The reactor 2 illustrated in FIG. 9 does not include the support member 16. In the reactor 2 illustrated in FIG. 9, the fixing portion 142 included in the bolt 14 located on the vertically lower side is formed as an insulating member. The fixing portion 142 included in the bolt 14 located on the vertically lower side abuts on the outer peripheral face of the coil 11 and is fixed to the coil 11, thereby supporting the coil 11 in the vertical direction. In other words, the fixing portion 142 included in the bolt 14 located on the vertically lower side corresponds to the support member 16 in FIG. 2. A groove, a notch, or the like to be fitted to the coil 11 is preferably formed on the outer peripheral face of a vertically upper part of the fixing portion 142 that corresponds to the support member 16.

Figure 10:
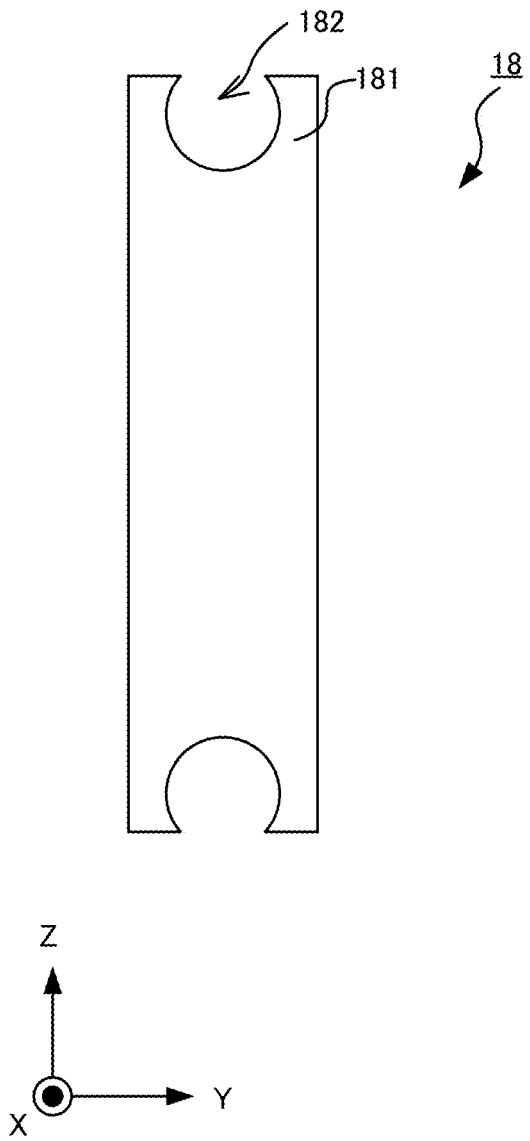
FIG. 10 is a side view of the first variation of the spacer according to the embodiment.

FIG. 10 is a side view of a first variation of the spacer according to the embodiment. The reactors 1 and 2 each may include spacers 18 instead of the spacers 13. Each of both ends of the spacer 18 in the Z-axis direction forms a projection part 181. The projection part 181 has a notch 182 that penetrates the projection part 181 in the X-axis direction and that extends in the Z-axis direction. The shape of the notch 182 in cross section perpendicular to the X-axis direction is a shape surrounded by an arc whose central angle is greater than 180 degrees and a straight line connecting both ends of the arc.

Figure 11:
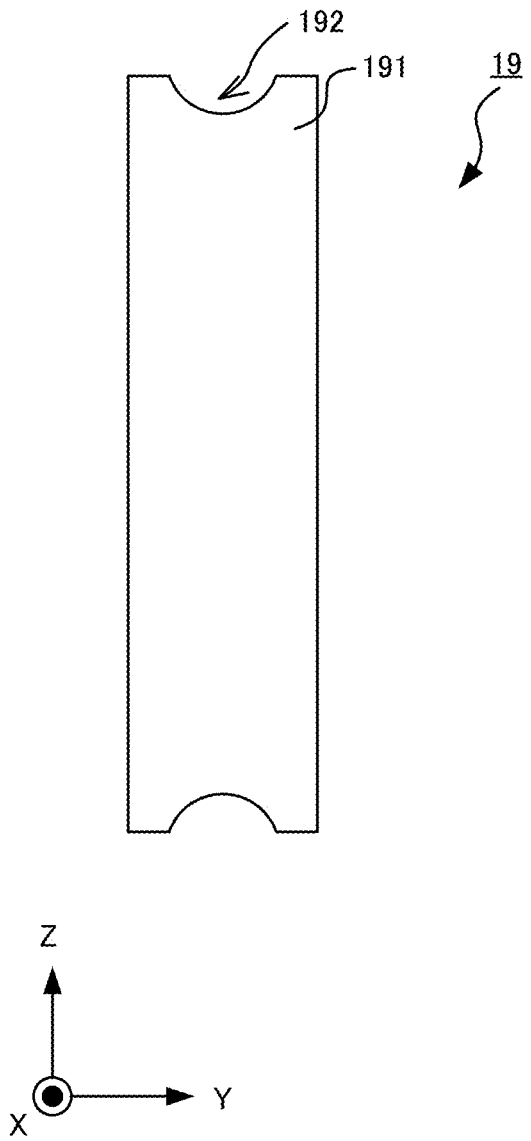
FIG. 11 is a side view of a second variation of the spacer according to the embodiment.

FIG. 11 is a side view of a second variation of the spacer according to the embodiment. The reactors 1 and 2 each may include spacers 19 instead of the spacers 13. As with the spacer 18, each of both ends of the spacer 19 in the Z-axis direction forms a projection part 191. The projection part 191 is provided with a notch 192 that penetrates the projection part 191 in the X-axis direction and that extends in the Z-axis direction. The shape of the notch 192 in cross section perpendicular to the X-axis direction is a shape surrounded by an arc whose central angle is less than 180 degrees and a straight line connecting both ends of the arc.

Figure 12:
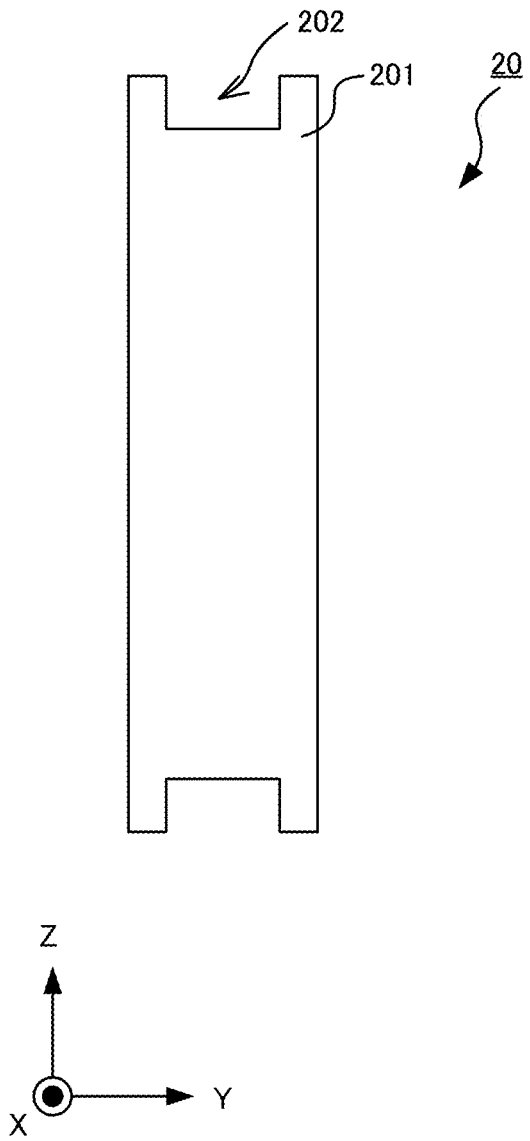
FIG. 12 is a side view of a third variation of the spacer according to the embodiment.

FIG. 12 is a side view of a third variation of the spacer according to the embodiment. The reactors 1 and 2 each may include a spacer 20 instead of the spacer 13. As with the spacer 18, each of both ends of the spacer 20 is the Z-axis direction forms a projection part 201. The projection part 201 is provided with a notch 202 that penetrates the projection part 201 in the X-axis direction and that extends in the Z-axis direction. The shape of the notch 202 in cross section perpendicular to the X-axis direction is a rectangle.

Figure 13:
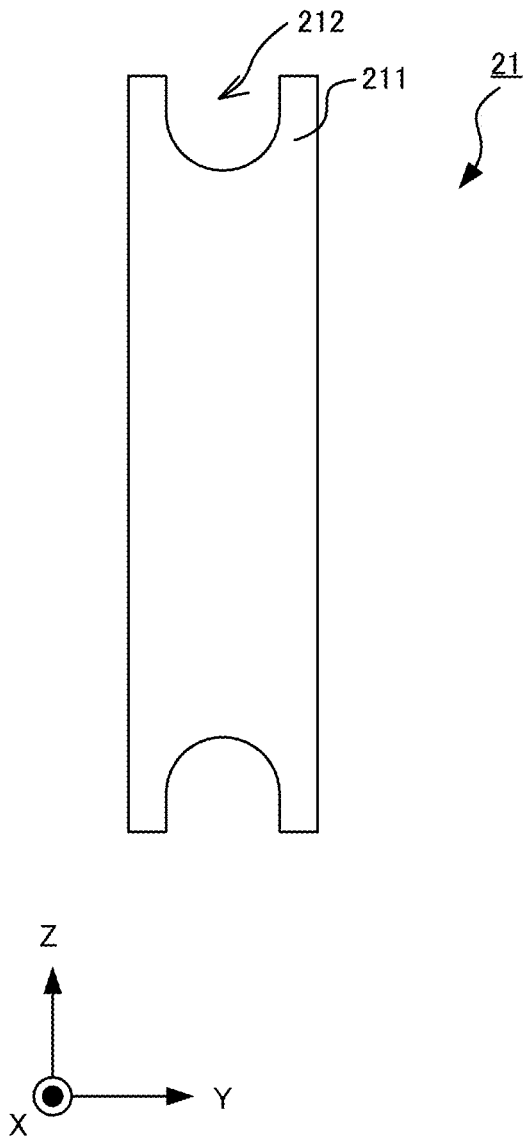
FIG. 13 is a side view of a fourth variation of the spacer according to the embodiment.

FIG. 13 is a side view of a fourth variation of the spacer according to the embodiment. The reactors 1 and 2 each may include a spacer 21 instead of the spacer 13. As with the spacer 18, each of both ends of the spacer 21 in the Z-axis direction forms a projection part 211. The projection part 211 is provided with a notch 212 that penetrates the projection part 211 in the X-axis direction and that extends in the Z-axis direction. The shape of the notch 212 in cross section perpendicular to the X-axis direction is made up of a semicircle and a rectangle having a side that is as long as the diameter of the semicircle.

Figure 14:
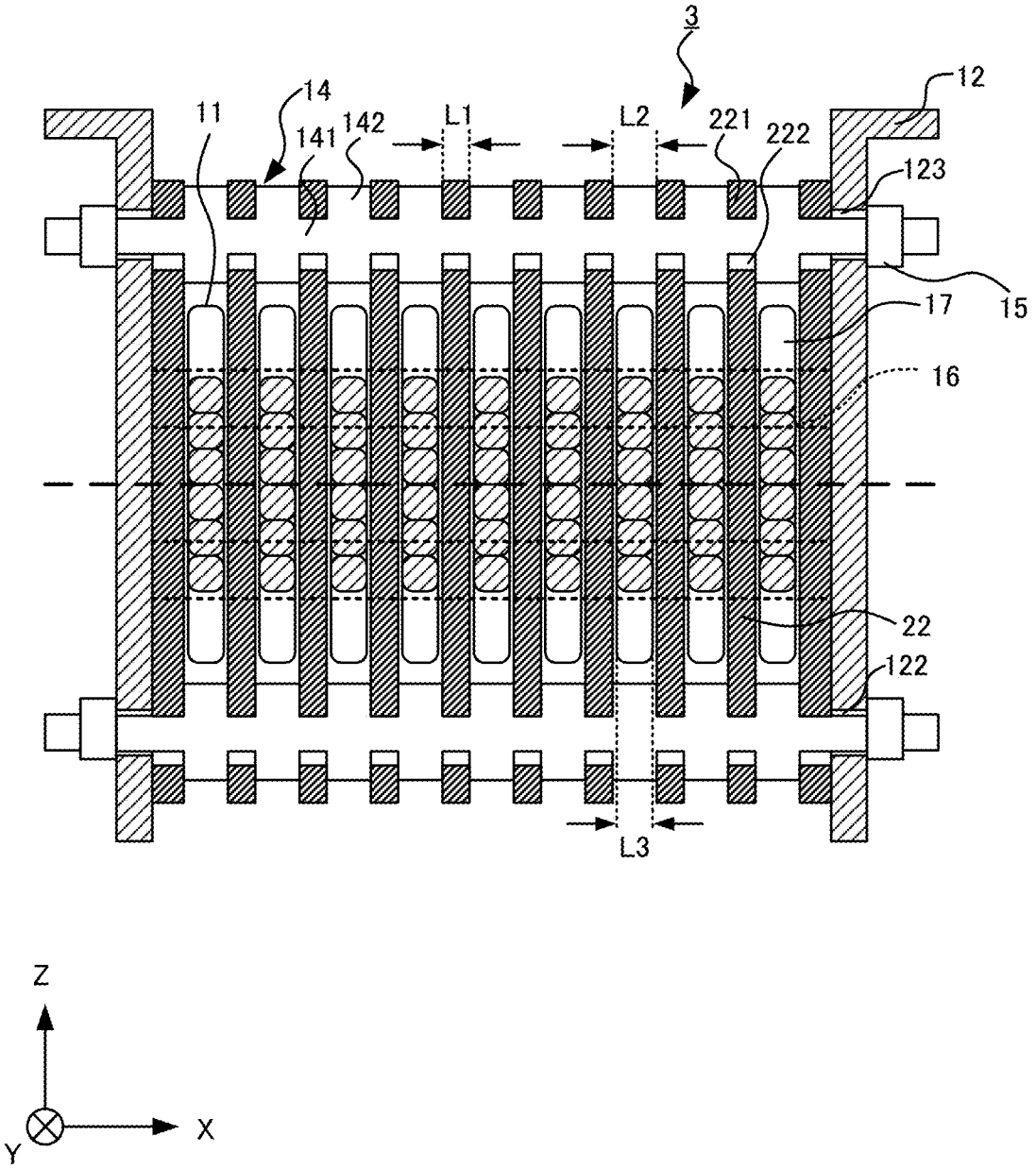
FIG. 14 is a cross-sectional view of a second variation of the reactor according to the embodiment.
Figure 15:
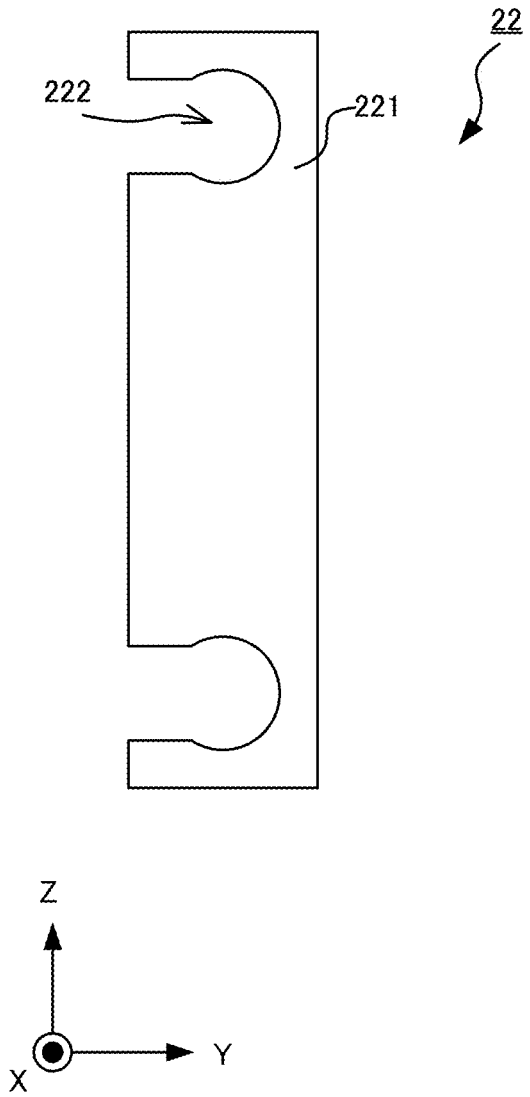
FIG. 15 is a side view of a fifth variation of the spacer according to the embodiment.

FIG. 14 is a cross-sectional view of a second variation of the reactor according to the embodiment. FIG. 15 is a side view of a fifth variation of the spacer according to the embodiment. The reactor 3 illustrated in FIG. 14 includes a spacer 22 instead of the spacer 13. Each of both ends of the spacer 22 in the Z-axis direction forms a projection part 221. The projection part 221 is provided with a notch 222 that penetrates the projection part 221 in the X-axis direction and that extends in the Y-axis direction. The shape of the notch 222 in cross section perpendicular to the X-axis direction is made by overlapping a portion shaped like a circle and a portion shaped like a rectangle. The reactor 3 is assembled as described below. One end of the support member 16 is fixed to one support frame 12 of the support frames 12. The bolt 14 passes through the insertion holes 122 and 123 of the one support frame 12. The spacer 22 is placed next to the one support frame 12 by fitting the notch 222 to the fitting portion 141 of the bolt 14. The notch 222 can be fitted to the fitting portion 141 of the bolt 14 that is fixed to the support frame 12 by moving the spacer 22 in the Y-axis direction. The unit coil 17 is placed at a position separate from the spacer 22. Then, the process of placing another spacer 22 and another unit coil 17 is repeated. After the last unit coil 17 is placed, the spacer 22 is placed. The other support frame 12 is placed next to this spacer 22, and the support member 16 is fixed to the other support frame 12. The fastening members 15 are fastened to the bolts 14, whereby the reactor 3 is completely assembled. The insertion hole 123 can be made smaller than the insertion hole 121 because of no need to move the bolt 14 along the Z-axis direction after placing the spacers 13 and the unit coils 17 as illustrated in FIG. 5.

Figure 16:
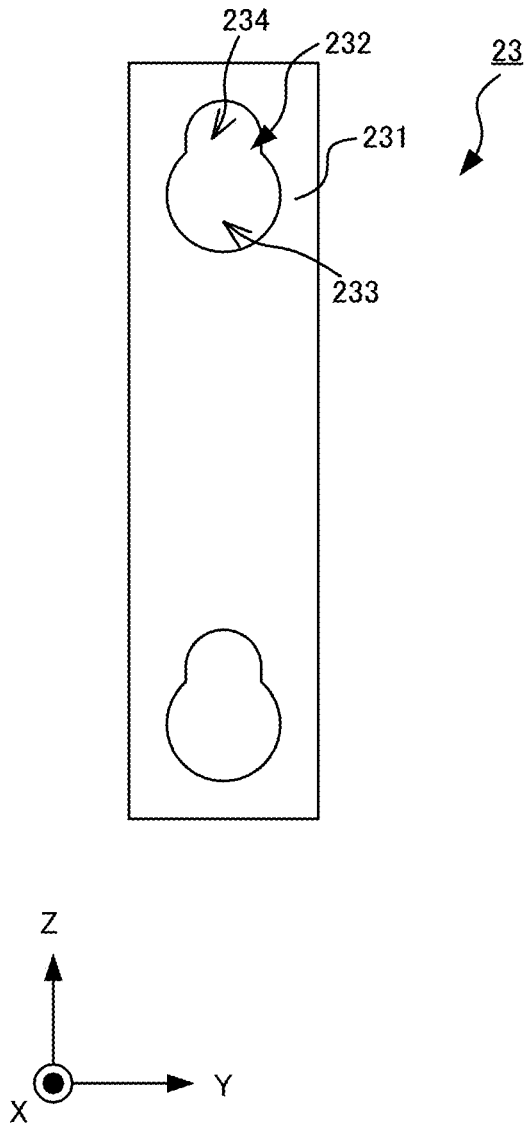
FIG. 16 is a side view of a sixth variation of the spacer according to the embodiment.

FIG. 16 is a side view of a sixth variation of the spacer according to the embodiment. The reactor 3 may include a spacer 23 instead of the spacer 22. Each of both ends of the spacer 23 in the Z-axis direction forms a projection part 231. The projection part 231 is provided with a through hole 232 that penetrates the projection part 231 in the X-axis direction. The through hole 232 is formed by overlapping a portion of a first through hole 233 into which the fixing portion 142 is insertable and a portion of a second through hole 234 into which the fitting portion 141 is insertable but the fixing portion 142 is not insertable. The reactor 3 that includes the spacer 23 is assembled as described below. One end of the support member 16 is fixed to one of the support frames 12. The bolt 14 passes through the insertion holes 122 and 123 of the one support frame 12. One end of the bolt 14 passes through the through hole 232, and the spacer 23 is moved in the X-axis direction. Then, the spacer 23 is moved along the Z-axis direction so that the through hole 232 is fitted to the fitting portion 141. The unit coil 17 is placed at a position separate from the spacer 23. Then, the process of placing another spacer 23 and another unit coil 17 is repeated. After the last unit coil 17 is placed, the spacer 23 is placed. The other support frame 12 is placed next to this spacer 23, and the support member 16 is fixed to the support frame 12. The fastening members 15 are fastened to the bolts 14, whereby the reactor 3 is completely assembled.

Figure 17:
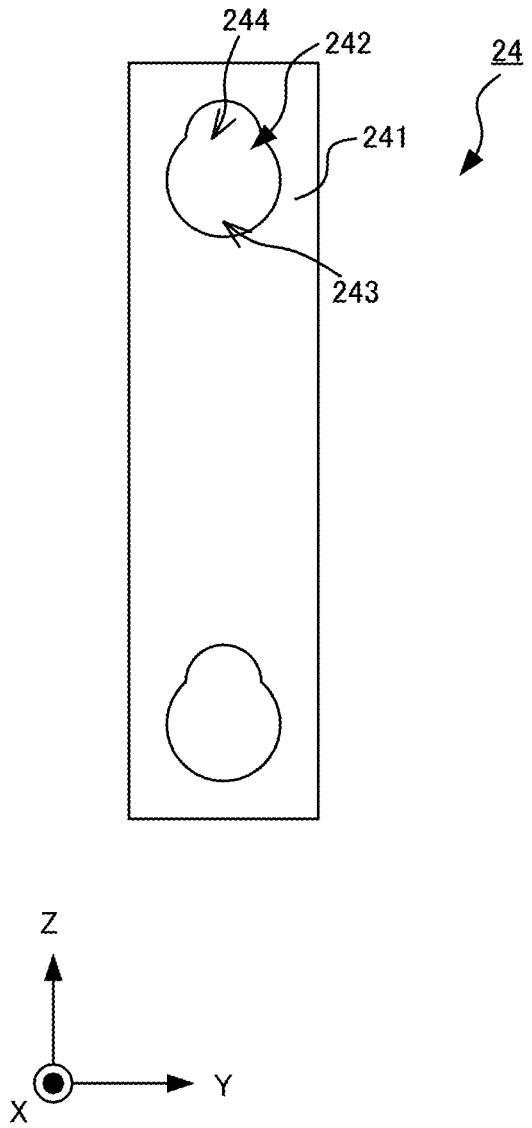
FIG. 17 is a side view of a seventh variation of the spacer according to the embodiment.

FIG. 17 is a side view of a seventh variation of the spacer according to the embodiment. The reactor 3 may include a spacer 24 instead of the spacer 22. As with the spacer 23, each of both ends of the spacer 24 in the Z-axis direction forms a projection part 241. The projection part 241 is provided with a through hole 242 that penetrates the projection part 241 in the X-axis direction. The through hole 242 is formed by overlapping a portion of a first through hole 243 into which the fixing portion 142 is insertable and a portion of a second through hole 244 into which the fitting portion 141 is insertable but the fixing portion 142 is not insertable. The reactor 3 that includes the spacer 24 is assembled in the same steps as in the assembly of the reactor 3 that includes the spacer 23.

Figure 18:
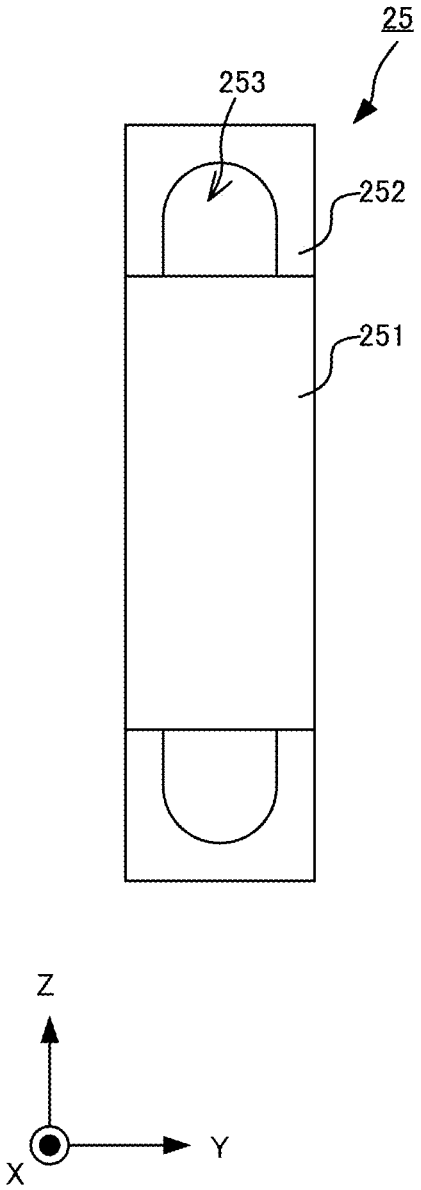
FIG. 18 is a side view of an eighth variation of the spacer according to the embodiment.

FIG. 18 is a side view of an eighth variation of the spacer according to the embodiment. The reactor 3 may include a spacer 25 instead of the spacer 22. The spacer 25 includes a plate-shaped first member 251 and a pair of second members 252. Each of the second members 252 is provided with a notch 253 that penetrates the second member 252 in the X-axis direction and that extends in the Z-axis direction. The pair of second members 252 is attached to both ends of the first member 251 in the Z-axis direction such that the notch 253 faces either of the both ends. The reactor 3 that includes the spacer 25 is assembled as described below. One end of the support member 16 is fixed to one support frame 12 of the support frames 12. The bolt 14 passes through the insertion holes 122 and 123 of the one support frame 12. The first member 251 is placed next to the one support frame 12 and between the fitting portions 141 along the Z-axis direction. The second members 252 are attached to both ends of the first member 251 in the Z-axis direction. The unit coil 17 is placed at a position separate from the spacer 25. Then, the process of placing another first member 251, attaching another second member 252 to the other first member 251, and placing another unit coil 17 is repeated. After the last unit coil 17 is placed, the first member 251 is placed and the second members 252 are attached to the first member 251. The other support frame 12 is placed next to the spacer 25, and the support member 16 is fixed to the other support frame 12. The fastening members 15 are fastened to the bolts 14, whereby the reactor 3 is completely assembled.

Figure 19:
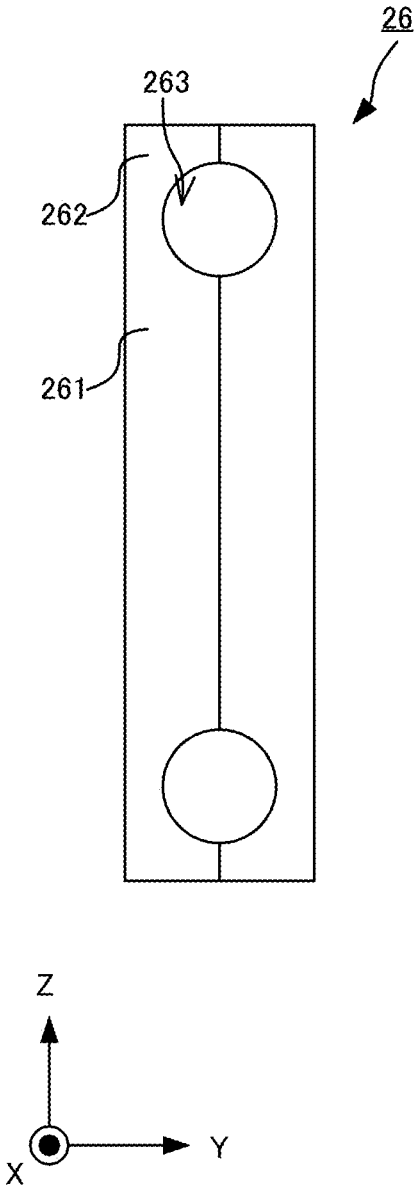
FIG. 19 is a side view of a ninth variation of the spacer according to the embodiment.

FIG. 19 is a side view of a ninth variation of the spacer according to the embodiment. The reactor 3 may include a spacer 26 instead of the spacer 22. The spacer 26 includes a pair of third members 261. Each of both ends of the third member 261 in the Z-axis direction forms a projection part 262. The projection part 262 is provided with a notch 263 that penetrates through in the X-axis direction and that extends in the Y-axis direction. In the example of FIG. 19, the shape of the notch 263 in cross section perpendicular to the X-axis direction is a semicircle. The pair of third members 261 is joined together such that the notches 263 face each other. The reactor 3 that includes the spacer 26 is assembled as described below. One end of the support member 16 is fixed to one support frame 12 of the support frames 12. The bolt 14 passes through the insertion holes 122 and 123 of the one support frame 12. The spacer 26 is placed next to the one support frame 12 by fitting each of the notches 263 in the pair of third members 261 to the fitting portion 141 of the bolt 14 and joining the pair of third members 261 together. The unit coil 17 is placed at a position separate from the spacer 26. Then, the process of placing another spacer 26 and another unit coil 17 is repeated. After the last unit coil 17 is placed, the spacer 26 is placed by fitting each of the notches 263 of each of the pair of third members 261 to the fitting portion 141 of the bolt 14 and joining the pair of third members 261 together. The other support frame 12 is placed next to the spacer 25, and the support member 16 is fixed to the other support frame 12. The fastening members 15 are fastened to the bolts 14, whereby the reactor 3 is completely assembled.

As described above, in the reactors 1, 2, and 3 according to the present embodiment, the fitting portion 141 to be fitted to the spacer 13 is disposed in the bolt 14, thereby reducing a load on the coil 11 based on a thermal stress that is caused when the temperature of the coil 11 is higher. In addition, the bolt 14 includes the fixing portion 142 disposed next to the fitting portion 141 to inhibit the spacer 13 from deviating in the central axis direction with respect to the bolt 14, thereby further enabling a reduction in a load on the coil 11 based on a thermal stress that is caused when the temperature of the coil 11 rises.

Embodiments of the present disclosure are not limited to the foregoing embodiments. The foregoing examples may be combined as appropriate. The reactor 1 may include different types of spacers. The spacers 13 extend in the Z-axis direction in the examples of FIGS. 1 and 2, but the reactor 1 may include spacers 13 extending in the Y-axis direction. In the spacer 13 extending in the Y-axis direction, the notch 132 extending in the Y-axis direction is formed in the projection part 131.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

REFERENCE SIGNS LIST

1, 2, 3, 4 Reactor
11, 41 Coil
12, 42 Support frame
13, 18, 19, 20, 21, 22, 23, 24, 25, 26, 43 Spacer
14, 44 Bolt
15, 45 Fastening member
16 Support member
17, 46 Unit coil
121, 122, 123 Insertion hole
131, 181, 191, 201, 211, 221, 231, 241, 262 Projection part
132, 182, 192, 202, 212, 222, 253, 263 Notch
141 Fitting portion
142 Fixing portion
232, 242 Through hole
233, 243 First through hole
234, 244 Second through hole
251 First member
252 Second member
261 Third member

The invention claimed is:

1. An air-core reactor for a vehicle comprising:

a coil having unit coils wound around a central axis that is horizontal, the unit coils being adjacent to each other with a space therebetween in a central axis direction that is a direction of the central axis;

a pair of support frames facing each other in the central axis direction with the coil sandwiched between the pair of support frames;

spacers disposed in (i) at least one of spaces between the unit coils adjacent to each other in the central axis direction and (ii) a space between each of the support frames and the coil, the spacers having projection parts that project outwardly from an outer peripheral face of the coil around the central axis, each of the projection parts having a notch or a through hole that penetrates the corresponding projection part in the central axis direction;

bolts passing through the notches or the through holes in the projection parts of the spacers and penetrating the pair of support frames;

fastening members fastened to the bolts to sandwich the pair of support frames so that the pair of support frames and the spacers are fixed to the bolts; and an insulating support member to vertically support the coil by abutting on the outer peripheral face of the coil or on an inner peripheral face of the coil around the central axis, wherein each of the bolts comprises fitting portions fitted to the spacers on the notches or the through holes in the projection parts of the spacers, each of the bolts includes a plurality of fixing portions, each of the fixing portions adjacent to at least one of the fitting portions, each spacer being inhibited from deviating in the central axis direction with respect to the bolts by a respective adjacent fixing portion, each of the spacers is disposed between the unit coils adjacent to each other, and a length of the fixing portion along the central axis direction is greater than a length along the central axis direction of the unit coil positioned between the fitting portions adjacent to the fixing portion when the coil is energized.

2. The air-core reactor according to claim 1, wherein the projection part has the notch extending in a vertical direction.

3. The air-core reactor according to claim 1, wherein the projection part has the notch extending in a direction perpendicular to the central axis and to a vertical direction.

4. The air-core reactor according to claim 1, comprising:

a plurality of pairs of the spacers opposing each other in a horizontal direction on opposite sides of the central axis and extending in a vertical direction, wherein both ends of each of the spacers in the vertical direction each have the projection part.

5. The air-core reactor according to claim 1, wherein both ends of the support member are fixed to the pair of support frames, and the support member vertically supports the coil by abutting on the inner peripheral face of the coil and being fixed to the coil.

6. The air-core reactor according to claim 1, wherein a length along the central axis direction of each spacer disposed between the unit coils adjacent to each other and a length along the central axis direction of the fitting portion fitted to the respective spacer are determined in accordance with a distance from the pair of support frames to the spacer.

7. The air-core reactor according to claim 6, wherein the length along the central axis direction of each spacer disposed between the unit coils adjacent to each other and the length along the central axis direction of the fitting portion fitted to the respective spacer become greater as a difference between distances from the pair of support frames to each spacer becomes smaller.

8. An air-core reactor for a vehicle comprising:

a coil having unit coils wound around a central axis that is horizontal, the unit coils being adjacent to each other with a space therebetween in a central axis direction that is a direction of the central axis;

a pair of support frames facing each other in the central axis direction with the coil sandwiched between the pair of support frames;

spacers disposed in (i) at least one of spaces between the unit coils adjacent to each other in the central axis direction and (ii) a space between each of the support frames and the coil, the spacers having projection parts that project outwardly from an outer peripheral face of the coil around the central axis, each of the projection parts having a notch or a through hole that penetrates the corresponding projection part in the central axis direction;

bolts passing through the notches or the through holes in the projection parts of the spacers and penetrating the pair of support frames;

fastening members fastened to the bolts to sandwich the pair of support frames so that the pair of support frames and the spacers are fixed to the bolts; and an insulating support member to vertically support the coil by abutting on the outer peripheral face of the coil or on an inner peripheral face of the coil around the central axis, wherein each of the bolts comprises fitting portions fitted to the spacers on the notches or the through holes in the projection parts of the spacers, and each of the spacers having the through hole comprises:

a plate-shaped first member; and a pair of second members each having the notch penetrating the second member in the central axis direction and extending in a vertical direction, the pair of second members being configured to be attached to the first member at both ends of the first member by the notch facing a corresponding one of the ends in the vertical direction.

9. The air-core reactor according to claim 8, wherein each of the bolts further comprises a fixing portion adjacent to at least one of the fitting portions, the fixing portion being configured to inhibit a spacer fitted to the adjacent fitting portion from deviating in the central axis direction with respect to the bolts, the spacer being included in the spacers.

10. The air-core reactor according to claim 9, wherein each through hole is formed by overlapping a portion of a first through hole into which the fixing portion is insertable and a portion of a second through hole into which the fitting portion is insertable but the fixing portion is not insertable.

11. The air-core reactor according to claim 10, wherein the fixing portion adjacent to the fitting portion to be fitted to the projection part formed by a vertically lower end of each of the spacers serves as the support member that is formed as an insulating member and vertically supports the coil by abutting on the outer peripheral face of the coil.

12. The air-core reactor according to claim 8, comprising:

a plurality of pairs of the spacers opposing each other in a horizontal direction on opposite sides of the central axis and extending in a vertical direction, wherein both ends of each of the spacers in the vertical direction each have the projection part.

13. The air-core reactor according to claim 8, wherein both ends of the support member are fixed to the pair of support frames, and the support member vertically supports the coil by abutting on the inner peripheral face of the coil and being fixed to the coil.

14. An air-core reactor for a vehicle comprising:

a coil having unit coils wound around a central axis that is horizontal, the unit coils being adjacent to each other with a space therebetween in a central axis direction that is a direction of the central axis;

a pair of support frames facing each other in the central axis direction with the coil sandwiched between the pair of support frames;

spacers disposed in (i) at least one of spaces between the unit coils adjacent to each other in the central axis direction and (ii) a space between each of the support frames and the coil, the spacers having projection parts that project outwardly from an outer peripheral face of the coil around the central axis, each of the projection parts having a notch or a through hole that penetrates the corresponding projection part in the central axis direction;

bolts passing through the notches or the through holes in the projection parts of the spacers and penetrating the pair of support frames;

fastening members fastened to the bolts to sandwich the pair of support frames so that the pair of support frames and the spacers are fixed to the bolts; and an insulating support member to vertically support the coil by abutting on the outer peripheral face of the coil or on an inner peripheral face of the coil around the central axis, wherein each of the bolts comprises fitting portions fitted to the spacers on the notches or the through holes in the projection parts of the spacers, and each of the spacers having the through hole comprises a pair of third members each having the notch penetrating the third member in the central axis direction and extending in a horizontal direction perpendicular to the central axis, and the pair of third members is jointed together with the notches facing each other.

15. The air-core reactor according to claim 14, wherein each of the bolts further comprises a fixing portion adjacent to at least one of the fitting portions, the fixing portion being configured to inhibit a spacer fitted to the adjacent fitting portion from deviating in the central axis direction with respect to the bolts, the spacer being included in the spacers.

16. The air-core reactor according to claim 15, wherein each through hole is formed by overlapping a portion of a first through hole into which the fixing portion is insertable and a portion of a second through hole into which the fitting portion is insertable but the fixing portion is not insertable.

17. The air-core reactor according to claim 15, wherein the fixing portion adjacent to the fitting portion to be fitted to the projection part formed by a vertically lower end of each of the spacers serves as the support member that is formed as an insulating member and vertically supports the coil by abutting on the outer peripheral face of the coil.

18. The air-core reactor according to claim 14, comprising:

a plurality of pairs of the spacers opposing each other in a horizontal direction on opposite sides of the central axis and extending in a vertical direction, wherein both ends of each of the spacers in the vertical direction each have the projection part.

19. The air-core reactor according to claim 14, wherein both ends of the support member are fixed to the pair of support frames, and the support member vertically supports the coil by abutting on the inner peripheral face of the coil and being fixed to the coil.

* * * * *